United States Patent [19]

Daniel et al.

[11] Patent Number: 4,794,694

[45] Date of Patent: Jan. 3, 1989

[54] BROAD PUTTY KNIFE WITH SNAP-ON TANG

[76] Inventors: Podlesny B. Daniel, 1050 George St., New Brunswick, N.J. 08901; Ralph Lopez, 219 Brookside Ave., Irvington, N.J. 07111; Kurt Waldner, 219 Gates Ave., Gillette, N.J. 07933

[21] Appl. No.: 150,831

[22] Filed: Feb. 1, 1988

[51] Int. Cl.[4] ..... B26B 3/00

[52] U.S. Cl. ..... 30/169; 15/236.01; 30/342; 30/344

[58] Field of Search ..... 30/169, 172, 329, 332, 30/333, 337, 339, 340, 342, 344; 15/236 R

[56] References Cited

U.S. PATENT DOCUMENTS

| | | | |
|---|---|---|---|
| 1,611,886 | 12/1926 | Champlin | 30/344 UX |
| 2,498,107 | 2/1950 | Ferguson | 30/342 |
| 3,201,869 | 8/1965 | Gambino | 30/342 |
| 4,524,514 | 6/1985 | Mallalieu et al. | 30/344 |

*Primary Examiner*—Douglas D. Watts

*Attorney, Agent, or Firm*—Thomas R. Morrison

[57] ABSTRACT

A knife has a snap-on tang interlocked with its blade and clamped between handle halves. Transverse and longitudinal locking between the blade and tang resists relative rotation or translation. Butterfly clips on the blade snap onto webs molded into one of the handle halves for resisting relative deformation therebetween. A further butterfly clip on the tang snaps onto a longitudinal web in a handle half for additional rigidity.

7 Claims, 6 Drawing Sheets

BROAD PUTTY KNIFE WITH SNAP-ON TANG

BACKGROUND OF THE INVENTION

The present invention relates to cutlery and, more particularly, to cutlery useful in construction or building improvement.

Although the present invention may find use in many other types of devices, for concreteness in the present disclosure, the following description is directed toward a putty knife of a type having a wide blade.

A putty knife conventionally includes a flat blade of tempered steel held in a two-part molded plastic handle, symmetrically disposed with respect to a center line of the blade. The blade is attached to the handle using grommets through aligned holes in the blade and halves of the handle. Particularly in the case of a wide blade, torques on the blade, both about its centerline and about a line normal to its center line, make it difficult to resist twisting and loosening in the handle.

Blades are sometimes positioned between metal handle halves and welded to the metal handle halves. In conventional devices, the handle halves are welded together at a number of positions about their abutting perimeters. Although it makes a secure assembly, welding is a relatively expensive technique. Also, after welding, additional finishing and painting steps are required to improve the rough appearance typically produced by welding. This adds further to the cost.

OBJECTS AND SUMMARY OF THE INVENTION

It is an object of the invention to provide an item of cutlery which overcomes the drawbacks of the prior art.

It is a further object of the invention to provide a putty knife having a blade held in a two-part molded plastic handle including means for resisting twisting of the blade.

It is a still further object of the invention to provide a putty knife including a blade with means for snapping the blade onto a web in a plastic handle half.

It is a still further object of the invention to provide a putty knife including a blade and a snap-on tang. The snap-on tang includes interlocking portions for forming a rigid lock with the blade, thereby preventing rotation of the tang with respect to the handle. The tang extends a substantial distance between facing handle halves for providing resistance to rotation of the blade with respect to the handle.

Briefly stated, the present invention provides a knife having a snap-on tang interlocked with its blade and clamped between handle halves. Transverse and longitudinal locking between the blade and tang resist relative rotation or translation. Butterfly clips on the blade snap onto webs molded into one of the handle halves for resisting relative deformation therebetween. A further butterfly clip on the tang snaps onto a longitudinal web in a handle half for additional rigidity.

According to an embodiment of the invention, there is provided a knife comprising: a blade, a tang, means for affixing the tang to the blade, a first handle half, a second handle half, means for mating the first and second handle halves together upon the tang, the means for affixing including first means for preventing relative translation between the blade and the tang, and second means for preventing relative rotation between the blade and the tang, and the means for affixing including means permitting at least one of the first and second means to snap into engagement with each other.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
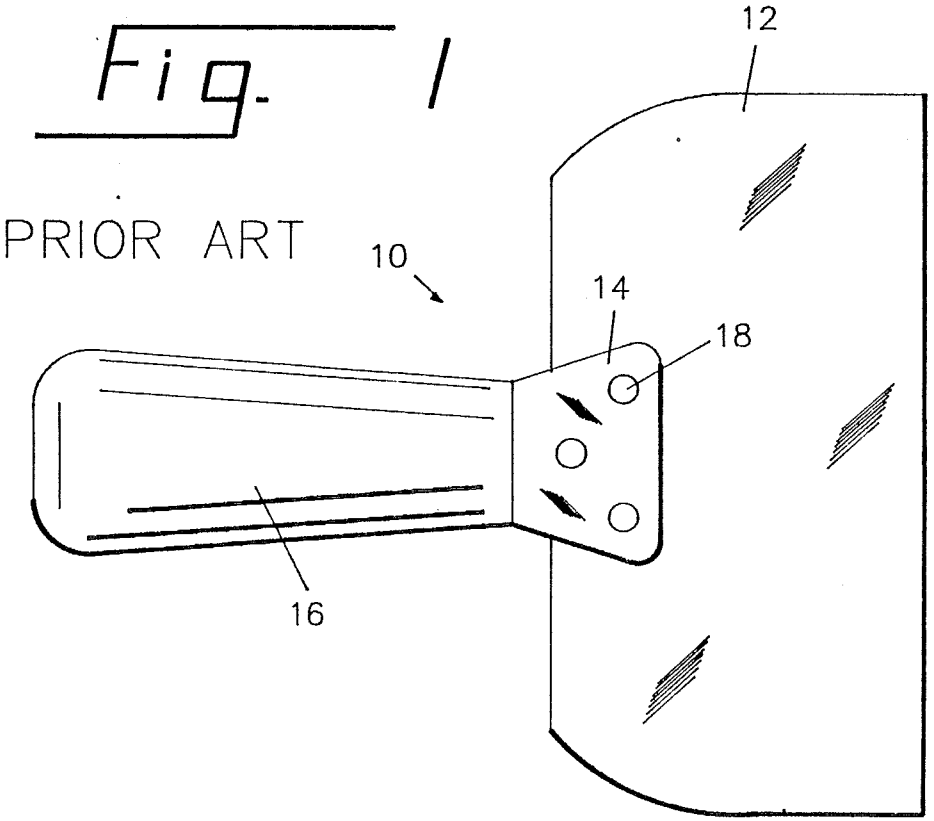
Fig. 1 PRIOR ART
FIG. 1 is a top view of a putty knife according to the prior art.

Referring to FIG. 1, there is shown, generally at 10, a putty knife according to the prior art. A blade 12 is secured to a connecting portion 14 of a metal handle 16 by any convenient means such as, for example, by a plurality of welds 18. Metal handle 16 is formed of two halves, welded together along their mating perimeters. As noted above, the welding and ensuing cosmetic operations add to the cost of putty knife 10.

Figure 2:
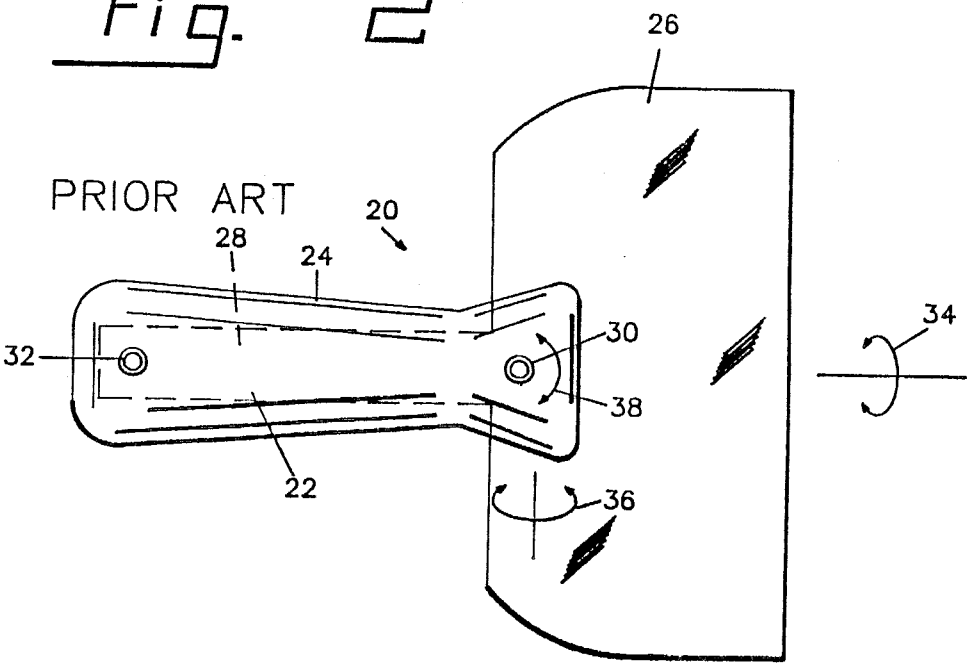
PRIOR ART Fig. 2
FIG. 2 is a top view of a putty knife according to a further embodiment of the prior art.

Referring now to FIG. 2, there is shown, generally at 20, a second type of putty knife. A molded plastic handle 22, preferably made up of a mating pair of identical handle halves 24 (only one of which is visible in FIG. 2), retains a blade 26. A tang 28, integrally formed with blade 26 extends along the length of molded plastic handle 22. A first eyelet 30 passes through aligned holes in handle halves 24 and blade 26. A second eyelet 32 passes through aligned holes in handle halves 24 and tang 28 near a distal extremity of molded plastic handle 22.

Blade 26 is subjected to three principal torques which must be absorbed by molded plastic handle 22. These consist of a roll torque 34, a pitch torque 36 and a yaw torque 38. As indicated by the arrows illustrating these torques, roll torque 34 acts about an axis passing through the center of molded plastic handle 22 and blade 26. Yaw torque 38 acts about an axis of eyelet 30, or an axis parallel thereto. Pitch torque 36 acts at right angles to the other two torques.

The location of eyelet 32 near a distal extremity of tang 28 provides a long lever arm for resisting yaw torque 38. The integral formation of tang 28 with blade 26 aids in resisting both roll torque 34 and pitch torque 36, aided by the clamping action of handle halves 24 against tang 28 and a portion of blade 26.

We have discovered that the conventional putty knife 20 in FIG. 2 is wasteful of resources. In particular, the square inches of raw material from which blade 26 and tang 28 are formed requires starting with a relatively large sheet of metal. Tempered steel, from which blade 26 is made, is available in rolls of a predetermined width. A serious cost impact is experienced in specifying wider rolls of steel, especially when a substantial part of the increased width ends up as scrap. A further disadvantage is found in that, the requirements of the material forming tang 28 are different from the requirements of the material forming blade 26. For example, since virtually all of yaw torque 38 acts in the plane of tang 28, adequate resistance to this torque is attainable using a material of a different thickness in tang 28 than is required in blade 26. Also, blade 26 requires a tempered spring steel capable of withstanding substantial bending without permanent deformation. Tang 28 does not require material of this quality and expense. When a one-piece assembly is employed, however, the entire blade 26 and tang 28 must be made of the more expensive tempered spring steel.

Figure 3:
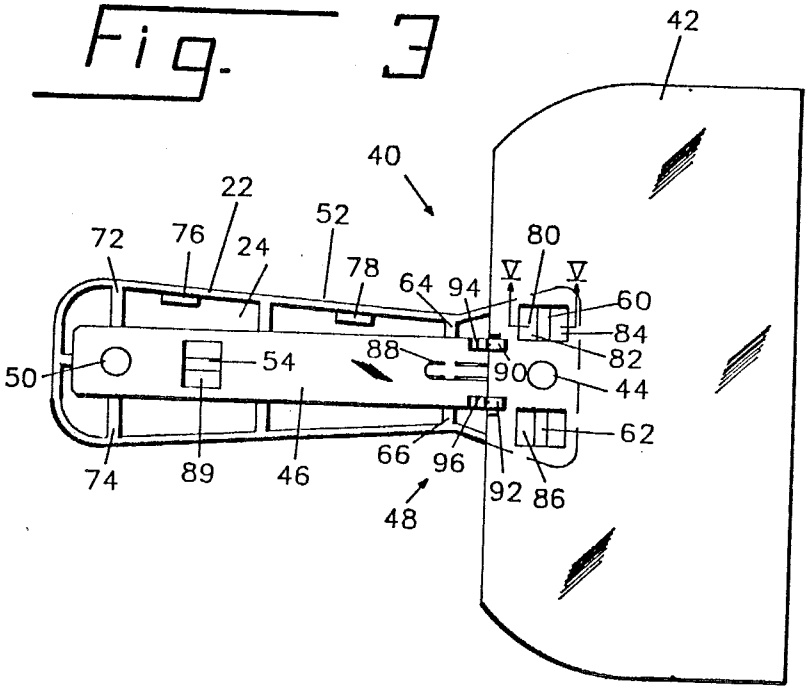
FIG. 3 is a top view of a putty knife according to an embodiment of the present invention, with one of its handle halves removed.

Referring now to FIG. 3, there is shown, generally at 40, a putty knife according to an embodiment of the invention. Only the lower handle half 24 of molded plastic handle 22 is shown, it being understood that the upper handle half 24 is preferably identical thereto. A blade 42 includes a hole 44 therein aligned with similar holes (not shown) in handle halves 24. A separate tang 46 is attached rigidly to blade 42 by a clip-on interlocking joint system shown generally at 48. Tang 46 includes a hole 50 in a distal end thereof aligned with similar holes in handle halves 24. During assembly, eyelets (not shown) are placed in holes 44 and 50 and swaged to lock putty knife 40, including the not-shown second handle half 24, into a completed assembly.

Figure 4:
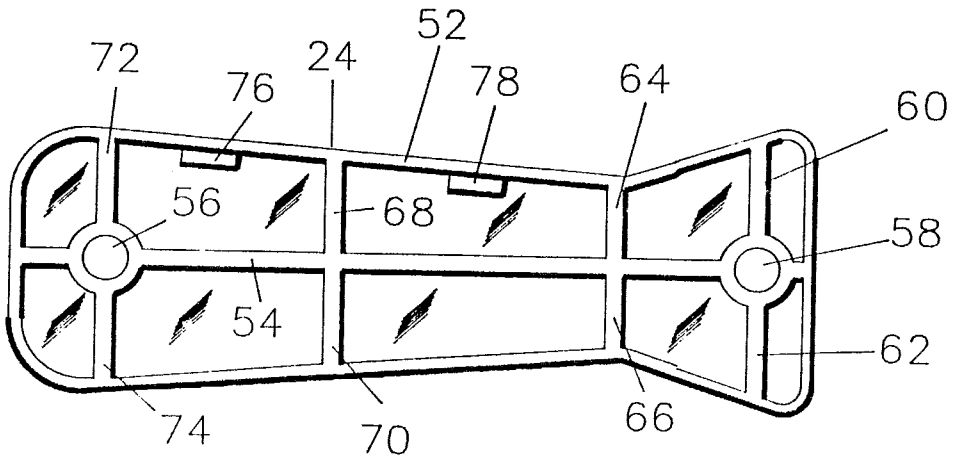
FIG. 4 is a top view of the handle half of FIG. 3 from which the remainder of the putty knife is removed.

Referring momentarily to FIG. 4 from which blade 42 and tang 46 have been removed to reveal details underneath, handle half 24 includes an outer perimeter wall 52 extending completely about its perimeter. An axial web 54 extends axially along handle half 24, interrupted by holes 56 and 58. A transverse web 60 crosses handle half 24 from outer perimeter wall 52 to one side of hole 58. A second transverse web 62 crosses handle half 24 from outer perimeter wall 52 to the other side of hole 58. Additional transverse webs 64, are disposed between outer perimeter wall 52 and axial web 54. As is well known to one skilled in the art, employing a outer perimeter wall 52 with axial web 54 and transverse webs 60–74 permits reducing the amount of material required to mold handle half 24 without substantially degrading its strength.

First and second alignment tabs 76 and 78 project beyond the top of outer perimeter wall 52 for interlocking with the second handle half 24 when assembled.

Figure 5:
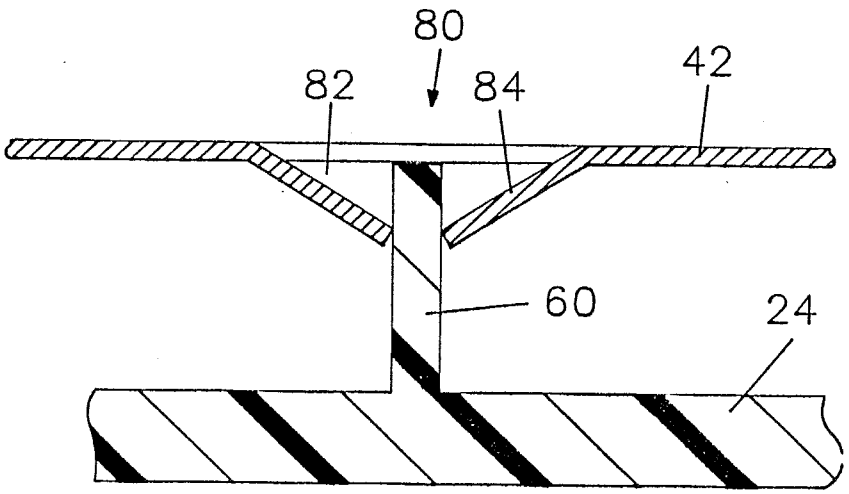
FIG. 5 is a cross section taken along V—V in FIG. 3.

Referring again to FIG. 3, blade 42 includes a butterfly clip 80, integrally formed with blade 42, in locking engagement with transverse web 60. Referring now also to FIG. 5, butterfly clip 80 includes first and second wings 82 and 84, formed by punching, or otherwise forming, appropriate cuts in blade 42. Wings 82 and 84 are deformed inward, whereby they engage opposed sides of transverse web 60 in a stabilizing, resiliently urged grip. A second butterfly clip 86 engages transverse web 62 in an identical manner. Due to the resilient urging permitting butterfly clips 80 and 86 to grip their respective transverse webs 60 and 62 at widely spaced-apart locations, substantial resistance to yaw torque 38 (FIG. 2) is provided.

Although other engaging means between blade 42 and webs 60 and 62 are considered to fall within the scope of the invention, butterfly clips 80 and 86 offer the advantage that blade 42 can be preassembled to handle half 24 by snapping butterfly clips 80 and 86 in place. This simplifies installation of the other handle half 24.

A butterfly clip 89 on tang 46 provides a resiliently urged grip on axial web 54 at a location far enough toward an extremity of tang 46 for further resisting yaw torque 38.

A longitudinal slot 88 provides relief for the double thickness of metal over axial web 54. Longitudinal slot 88 preferably extends slightly beyond the junction of axial web 54 and transverse webs 64 and 66.

First and second clips 90 and 92 are formed by slits 94 and 96, respectively, made in tang 46, and deformed upward to permit them to slide over the upper surface of blade 42.

Figure 6:
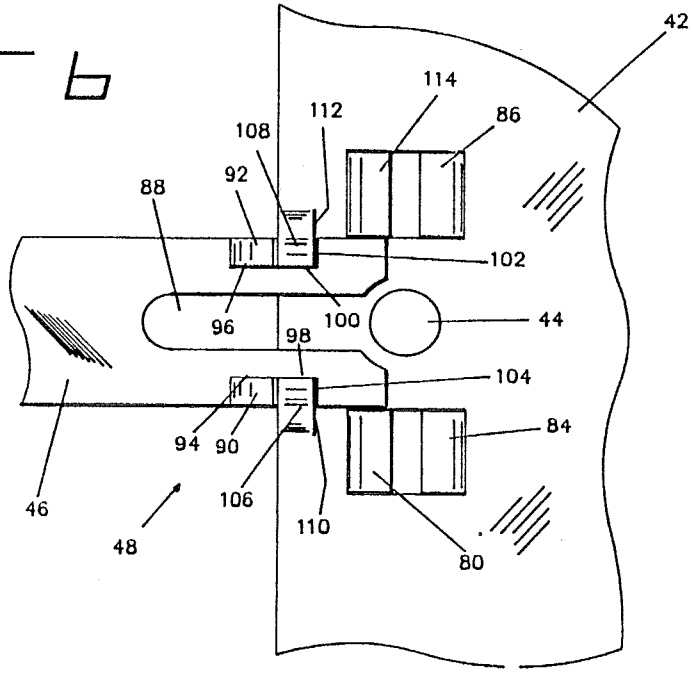
FIG. 6 is an enlarged view of portions of the tang and blade of FIG. 3, showing the opposite sides thereof to illustrate the manner in which they lock together with a snap action.

Referring now to FIG. 6, blade 42 and tang 46 are rotated about a longitudinal axis to reveal a side which was hidden in the view of FIG. 3. Handle half 24 is omitted from the figure. It will be noted that slits 94 and 96, permitting the deformation of clips 90 and 92 to the hidden side of blade 42, also form slots 98 and 100 having abutment surfaces 102 and 104. A pair of tabs 106 and 108, formed by slits 110 and 112 in blade 42, are deformed into the plane of tang 46.

Nearest portions of butterfly clips 80 and 86 are spaced apart a distance substantially equal to the width of tang 46. Facing edges of wing 82 in butterfly clip 80 and wing 114 in butterfly clip 86, deformed upward from the plane of the page in FIG. 6, abut the edges of tang 46 to provide lateral stability. The ends of tabs 106 and 108 similarly abut slits 94 and 96, respectively. The ends of clips 90 and 92 abut abutment surfaces 102 and 104, respectively, to prevent removal of tang 46 from blade 42. When clamped between handle halves 24, all relative motion between tang 46 and blade 42 is prevented, whereby the assembled and locked condition shown in FIG. 6 is maintained.

In some applications, tang 46 may be omitted and the stability of blade 42 in molded plastic handle 22 may be provided by the clamping action of butterfly clips 80 and 86 on transverse web 60*s* and 62 (FIG. 3). Also, an embodiment of the invention is contemplated in which blade 42 and tang 46 are formed of a single piece of material and the rigidity of putty knife 40 is enhanced using at least some of butterfly clips 80, 86 and 89.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What we claim is:

1. A knife comprising:

a blade;

a tang;

means for affixing said tang to said blade;

a first handle half;

a second handle half;

means for mating said first and second handle halves together upon said tang;

said means for affixing including first means for preventing relative translation between said blade and said tang, and second means for preventing relative rotation between said blade and said tang; and said means for affixing including means permitting at least one of said first and second means to snap into engagement with each other.

2. A knife according to claim 1, wherein:

said first handle half includes at least one web; and said blade includes means for engaging said at least one web, whereby relative motion of said blade and said first handle half is prevented.

3. A knife according to claim 2 wherein said means for engaging includes at least one butterfly clip in said blade, said butterfly clip including means for clamping onto first and second sides of said web.

4. A knife according to claim 1, further comprising:

said first handle half including at least one web; and said tang including means for engaging said at least one web, whereby relative motion of said tang and said first handle half is prevented.

5. A knife according to claim 1 wherein said means for engaging includes at least one butterfly clip in said tang, said butterfly clip clamping onto first and second sides of said web.

6. A knife according to claim 1, wherein said means for affixing includes:

first and second slits parallel to opposed edges of said tang;

said first and second slits forming first and second clips;

said first and second clips being deformed in a first direction out of the plane of said tang;

first and second tabs formed in an edge of said blade;

said first and second tabs being deformed in a second direction out of the plane of said tang;

said first and second clips fitting over an edge of said blade;

deformation of said first and second tabs placing ends thereof in the plane of said tang;

said ends bearing against edges formed by said first and second slits, whereby transverse connection is made between said blade and said tang;

said tang including first and second abutment surfaces formed by said first and second slits respectively; and said first and second abutment surfaces sliding over said first and second tabs and locking behind surfaces of said first and second tabs, whereby longitudinal connection is made between said blade and said tang.

7. A knife comprising:

a blade;

a tang affixed to said blade;

first and second handle halves;

first and second butterfly clips spaced apart on said blade;

said first butterfly clip having first and second wings deformed out of the plane of said blade in a direction of a plane of said tang;

said second butterfly clip having third and fourth wings deformed out of the plane of said blade in a direction of a plane of said tang;

at least one web in said first handle half;

said first and second butterfly clips being capable of clamping onto said at least one web;

first and second edges of said tang passing between said first and third wings; and said first and third wings being spaced to contact said first and second edges, whereby transverse engagement between said tang and said blade is attained.

* * * * *